US009660747B2

(12) United States Patent
Lin et al.

(10) Patent No.: US 9,660,747 B2
(45) Date of Patent: May 23, 2017

(54) MEDIA SIGNAL BROADCASTING METHOD, MEDIA SIGNAL BROADCASTING SYSTEM, HOST DEVICE AND PERIPHERAL DEVICE

(71) Applicant: HTC Corporation, Taoyuan County (TW)

(72) Inventors: Chih-Hao Lin, Taoyuan County (TW); Fu-An Chu, Taoyuan County (TW); Chien-Yen Li, Taoyuan County (TW)

(73) Assignee: HTC CORPORATION, Taoyuan County (TW)

( * ) Notice: Subject to any disclaimer, the term of this patent is extended or adjusted under 35 U.S.C. 154(b) by 434 days.

(21) Appl. No.: 14/014,342

(22) Filed: Aug. 29, 2013

(65) Prior Publication Data

US 2015/0065032 A1 Mar. 5, 2015

(51) Int. Cl.
*H04H 20/71* (2008.01)
*H04H 60/11* (2008.01)
*H04H 20/08* (2008.01)

(52) U.S. Cl.
CPC ..... *H04H 60/11* (2013.01); *H04H 20/08* (2013.01)

(58) Field of Classification Search
None
See application file for complete search history.

(56) References Cited

U.S. PATENT DOCUMENTS

| | | | | |
|---|---|---|---|---|
| 7,260,764 | B2 * | 8/2007 | Chen | H04L 1/0041 714/751 |
| 7,574,177 | B2 | 8/2009 | Tupman et al. | |
| 7,949,810 | B2 | 5/2011 | Bolton et al. | |
| 8,335,175 | B2 | 12/2012 | Das et al. | |
| 2007/0206827 | A1 * | 9/2007 | Tupman | H04H 60/74 381/334 |
| 2009/0210079 | A1 | 8/2009 | Schubert et al. | |
| 2010/0060423 | A1 * | 3/2010 | Pillai | H04Q 9/00 340/10.1 |
| 2011/0050908 | A1 * | 3/2011 | Nam | H04L 1/0001 348/192 |
| 2011/0051693 | A1 * | 3/2011 | Hsu | H04W 36/24 370/332 |
| 2013/0182589 | A1 * | 7/2013 | Tolentino | H04B 15/00 370/252 |

* cited by examiner

*Primary Examiner* — Mohammed Rachedine
(74) *Attorney, Agent, or Firm* — Rabin & Berdo, P.C.

(57) ABSTRACT

A media signal broadcasting method, a media signal broadcasting system, a host device and a peripheral device are provided. The media signal broadcasting method is provided. The media signal broadcasting method includes the following steps. A host device and a peripheral device are provided. A first radio signal is received by the peripheral device. The first radio signal is converted to be a second radio signal by the peripheral device. The second radio signal is transmitted to the host device by the peripheral device. The second radio signal is received and is converted to be a media signal by the host device. A third radio signal is received and converted to be the media signal by the host device. The media signal converted from the third radio signal or the second radio signal is played by the host device.

24 Claims, 4 Drawing Sheets

MEDIA SIGNAL BROADCASTING METHOD, MEDIA SIGNAL BROADCASTING SYSTEM, HOST DEVICE AND PERIPHERAL DEVICE

TECHNICAL FIELD

The disclosure relates in general to a broadcasting method, a broadcasting system, a host device and a peripheral device, and more particularly to a media signal broadcasting method, a media signal broadcasting system, a host device and a peripheral device.

BACKGROUND

Accompanying advancements in technologies, various electronic devices are constantly progressing. For example, some media devices can broadcast a radio signal received from a radio tower or a network server.

However, in some case, the media device cannot receive the radio signal very well due to the location. The user must move to a new location to try again. It is inconvenient for the user to use the media device.

SUMMARY

The disclosure is directed to a media signal broadcasting method, a media signal broadcasting system, a host device and a peripheral device.

According to one embodiment, a media signal broadcasting method is provided. The media signal broadcasting method includes the following steps. A host device and a peripheral device are provided. A first radio signal is received by the peripheral device. The first radio signal is converted to be a second radio signal by the peripheral device. The second radio signal is transmitted to the host device by the peripheral device. The second radio signal is received and converted to be a media signal by the host device. A third radio signal is received and converted to be the media signal by the host device. The media signal converted from the third radio signal or the second radio signal is played by the host device.

According to another embodiment, a media signal broadcasting system is provided. The media signal broadcasting system includes a host device and a peripheral device. The host device includes a first transceiver, a first processing unit and an outputting unit. The first transceiver is used for receiving a third radio signal. The first processing unit is used for converting the third radio signal to be a media signal. The peripheral device includes a second transceiver and a second processing unit. The second transceiver is used for receiving a first radio signal. The second processing unit is used for converting the first radio signal to be a second radio signal. The first transceiver is used for receiving the second radio signal transmitted from the second transceiver. The first processing unit is further used for converting the second radio signal to be the media signal. The outputting unit is used for playing the media signal converted from the third radio signal or the second radio signal.

According to an alternative embodiment, a peripheral device is provided. The peripheral device includes a transceiver and a processing unit. The transceiver is used for receiving a first radio signal. The processing unit is used for converting the first radio signal to be a second radio signal. A host device is used for receiving the second radio signal and a third radio signal. The second radio signal is transmitted from the transceiver of the peripheral device. The host device is further used for playing a media signal converted from the third radio signal or the second radio signal.

According to another embodiment, a host device is provided. The host device includes a transceiver, a processing unit and an outputting unit. The transceiver is used for receiving a third radio signal and a second radio signal. The second radio signal is converted from a first radio signal received by a peripheral device. The processing unit is used for converting the third radio signal or the second signal radio signal to be a media signal. The outputting unit is for playing the media signal converted from the third radio signal or the second radio signal.

Figure 1:
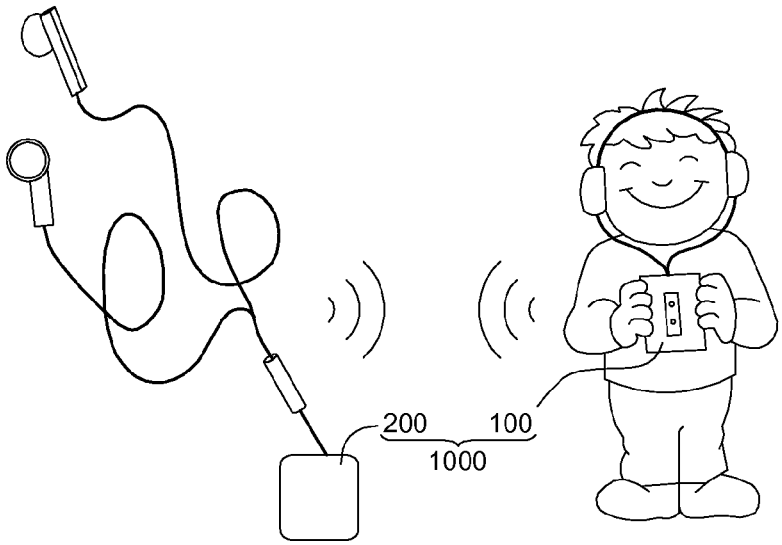
FIGS. 1 and 2 show a media signal broadcasting system.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

Figure 2:
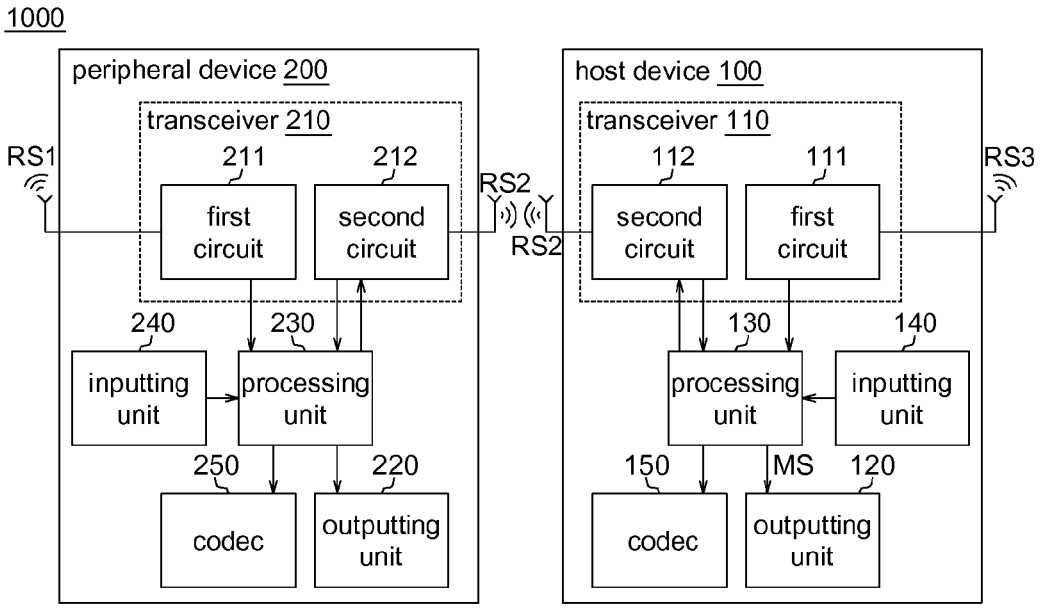

Please referring to FIGS. 1 and 2, a media signal broadcasting system 1000 is shown. The media signal broadcasting system 1000 includes a host device 100 and a peripheral device 200. The host device 100 can be a notebook computer, a media player, a smart phone, a tablet computer or a television. The peripheral device 200 can be an earphone module, a horn module, an antenna module, a remote controller, a computer mouse or a keyboard. The peripheral device 200 expands the host device 100 but does not form part of the core architecture. The peripheral device 200 is often, but not always, partially or completely dependent on the host device 100.

The host device 100 includes, but not limited to, a transceiver 110, an outputting unit 120, a processing unit 130, an inputting unit 140 and a codec 150. The peripheral device 200 includes, but not limited to, a transceiver 210, an outputting unit 220, a processing unit 230, an inputting unit 240 and a codec 250.

The transceiver 110 and the transceiver 210 are respectively used for receiving or transmitting a radio signal. For example, the transceiver 110 and the transceiver 210 can be composed of an antenna, a radio frequency module, an amplifier or a modulator.

The outputting unit 120 and the outputting unit 220 are used for outputting text data, image data, video data or audio data. For example, the outputting unit 120 and the outputting unit 220 can be a display, a speaker or a printer.

The processing unit 130 and the processing unit 230 are used for performing varied processing, calculating, or converting, or analyzing procedures. For example, the processing unit 130 and the processing unit 230 can be a chip, a circuit firmware, or a storage medium storing a plurality of program codes.

The inputting unit 140 and the inputting unit 240 are used for inputting commands or setup data. For example, the inputting unit 140 and the inputting unit 240 can be a display having a user interface, a press-button or a scroll button.

The codec 150 and the codec 250 are used for of encoding or decoding a radio signal. For example, the codec 150 and the codec 250 can be a chip, a circuit firmware, or a storage medium storing a plurality of program codes.

In FIG. 2, the elements of the host device 100 and the peripheral device 200 are similar. However, in one example, the elements of the host device 100 and the peripheral device 200 can be different. For example, the outputting unit 220, the inputting unit 240 and the codec 250 can be omitted.

In FIG. 2, the transceiver 110 includes a first circuit 111 and a second circuit 112, and the transceiver 210 includes a first circuit 211 and a second circuit 212. The first circuits 111 and the first circuit 211 are used for receiving a radio signal from a radio tower or a network server. For example, the first circuit 111 and the first circuit 211 can be a radio receiving module, a TV receiving module, a wireless network receiving module, or a cell phone receiving module.

The second circuit 112 and the second circuit 212 are used for transmitting text data, image data, video data or audio data between the host device 100 and the peripheral device 200. For example, the second circuit 112 and the second circuit 212 can be a Bluetooth transmitting module, a wireless network transmitting module.

In one embodiment, the frequency bandwidth corresponding the first circuit 111 and that corresponding the first circuit 211 are the same, and the frequency bandwidth corresponding the second circuit 112 and that corresponding the second circuit 212 are the same.

Figure 3A:
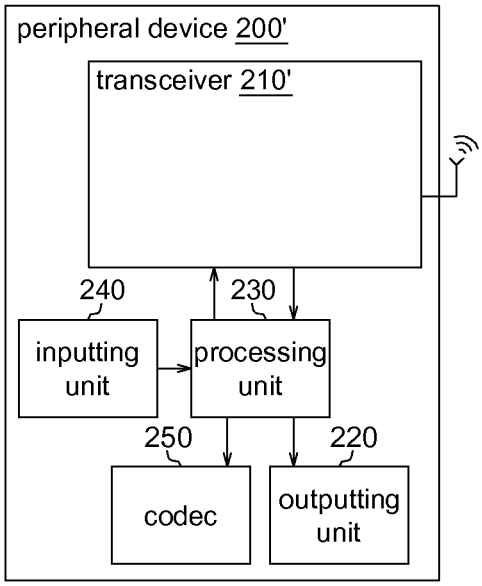
FIG. 3A shows a peripheral device.

In one embodiment, the frequency bandwidth corresponding the first circuit 211 and that corresponding the second circuit 212 can be the same, such that the first circuit 211 and the second circuit 212 can be integrated into one piece. For example, please referring to FIG. 3A, a peripheral device 200' is shown. In FIG. 3A, the transceiver 210' can serve with the function of first circuit 211 and the function of the second circuit 212.

Figure 3B:
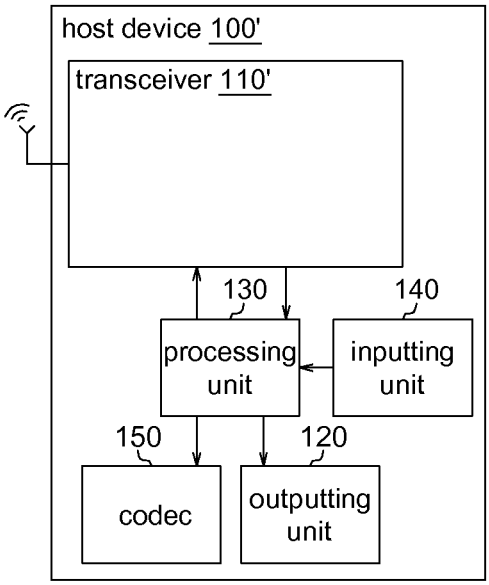
FIG. 3B shows a host device.

In one embodiment, the frequency bandwidth corresponding the first circuit 111 and that corresponding the second circuit 112 can be the same, such that the first circuit 111 and the second circuit 112 can be integrated into one piece. For example, please referring to FIG. 3B, a host device 100' is shown. In FIG. 3A, the transceiver 110' can serve with the function of first circuit 111 and the function of the second circuit 112.

The media signal broadcasting system 1000 described above can receive a radio signal by the host device 100 or the peripheral device 200 selectively. In some case, the host device 100 cannot receive the radio signal very well due to the location. In that case, the peripheral device 200 can receive the radio signal and then transmits the content of the radio signal to the host device 100. Therefore, the host device 100 can play the radio signal very well, even if the location is not suitable for receiving the radio signal.

Figure 4A:
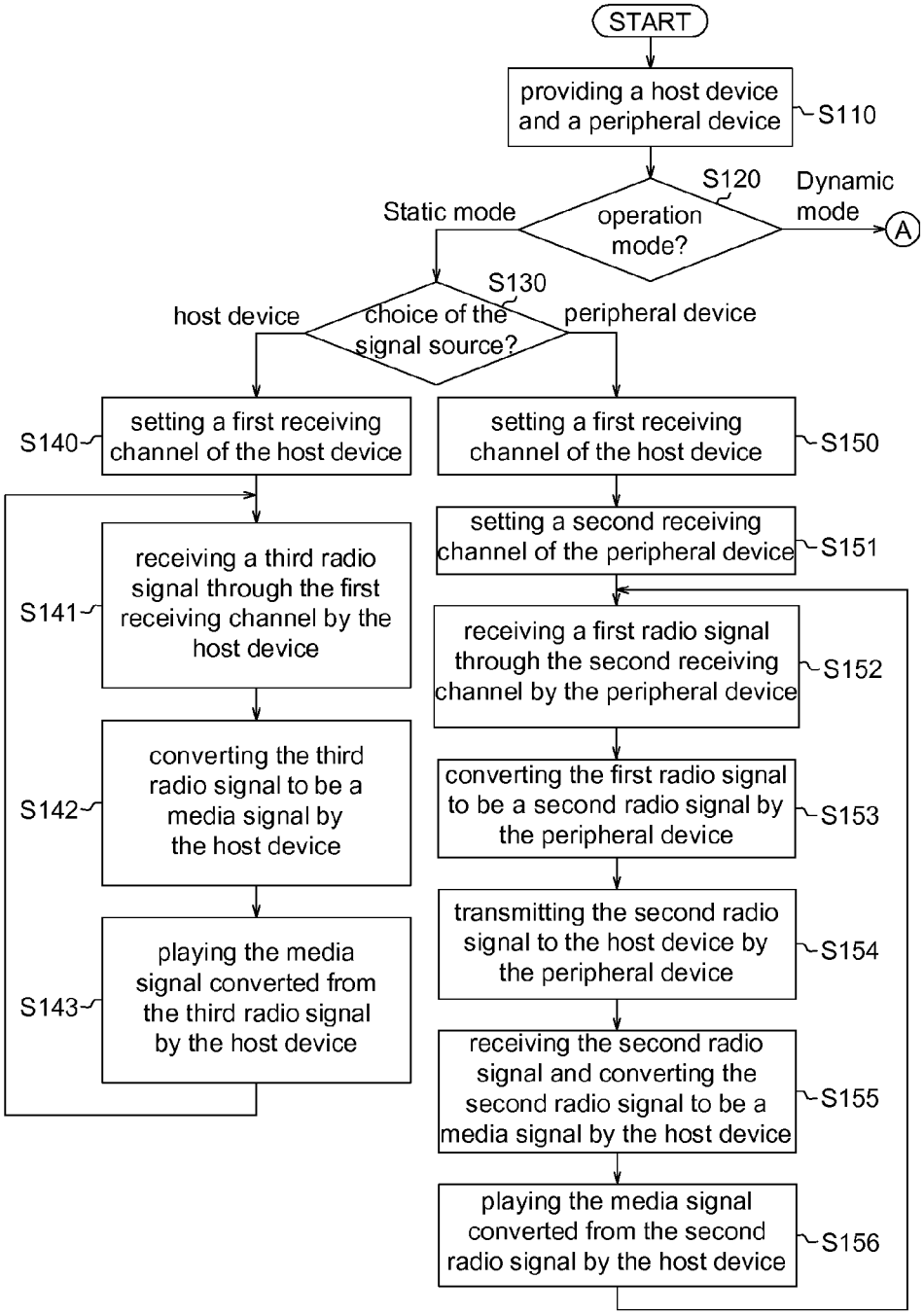
FIGS. 4A and 4B show a flowchart of a media signal broadcasting method.
Figure 4B:
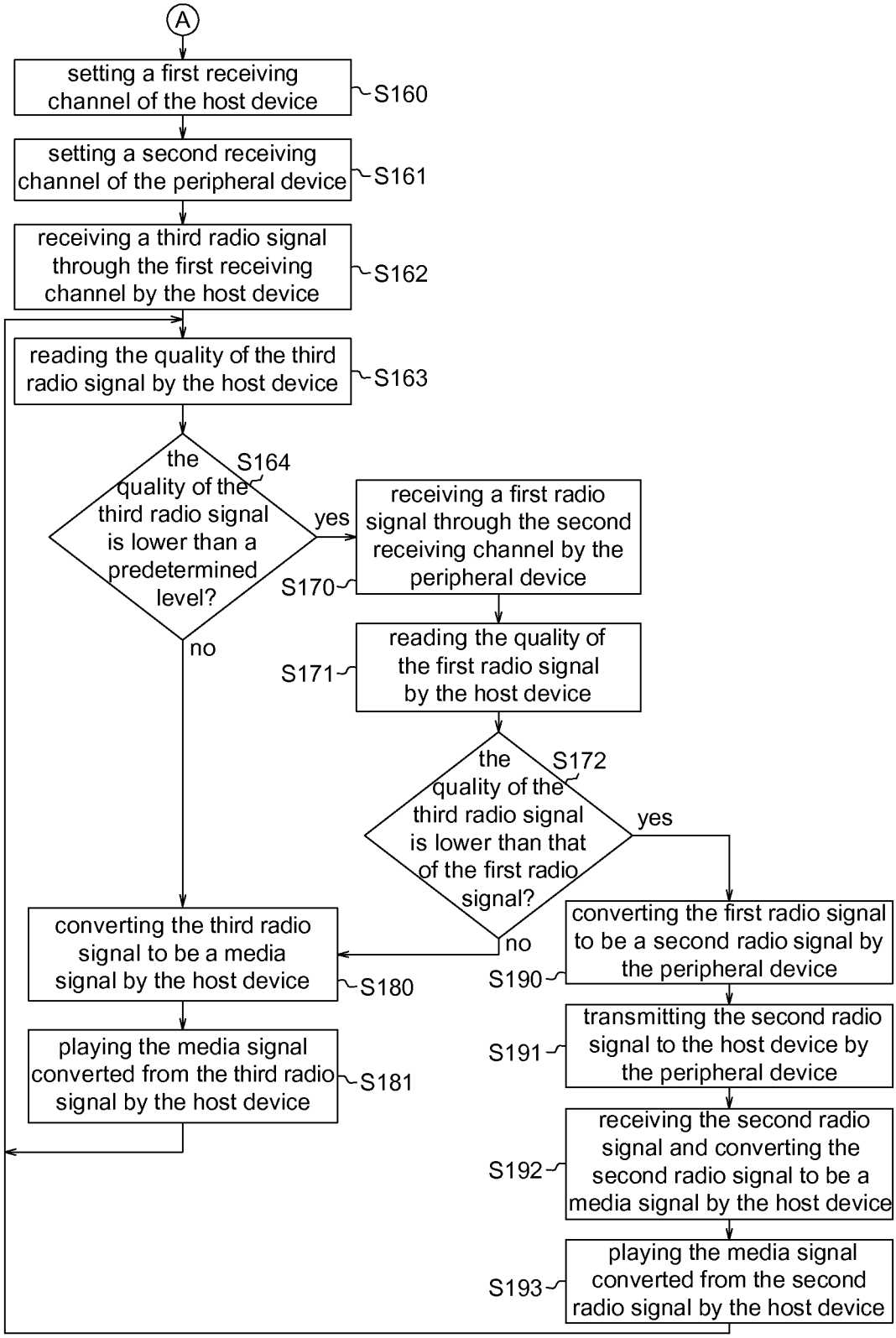

Please referring to FIGS. 4A and 4B, a flowchart of a media signal broadcasting method is shown. The operations of the elements of the host device 100 and the peripheral device 200 are illustrated by the exemplary flowchart.

In the step S110, the host device 100 and the peripheral device 200 are provided.

In the step S120, the operation mode is determined. The operation mode includes a static mode and a dynamic mode. In the static mode, the signal source of the media signal broadcasting system 1000 is fixed at the host device 100 or the peripheral device 200. In the dynamic mode, the signal source of the media signal broadcasting system 1000 can be dynamically changed between the host device 100 and the peripheral device 200. If the operation mode is the static mode, then the process proceeds to the step S130; if the operation mode is the dynamic mode, then the process proceeds to the step S160 (shown in the FIG. 4B).

In the step S130, the choice of the signal source is determined. The signal source can be preset by the user. If the choice of the signal source is the host device 100, then the process proceeds to the step S140; if the choice of the signal source is the peripheral device 200, then the process proceeds to the step S150.

In the step S140, a first receiving channel of the host device 100 is set. For example, the first receiving channel can be a radio channel or a TV channel.

In the step S141, a third radio signal RS3 is received through the first receiving channel by the transceiver 110 of the host device 100. For example, the third radio signal RS3 can be a frequency modulation (FM) signal or a television signal.

In the step S142, the third radio signal RS3 is converted to be a media signal MS by the processing unit 130 of the host device 100.

In the step S143, the media signal MS converted from the third radio signal RS3 is played by the outputting unit 120 of the host device 100.

In the step S150, the first receiving channel of the host device 100 is set.

In the step S151, a second receiving channel of the peripheral device 200 corresponding to the first receiving channel is set by the host device 100. For example, the second receiving channel can be a radio channel or a TV channel. In this step, the host device 100 can transmit a command to the peripheral device 200 for controlling the peripheral device 200 to set the second receiving channel by the transceiver 110 and the transceiver 210.

In the step S152, a first radio signal RS1 is received through the second receiving channel by the transceiver 210 of the peripheral device 200. For example, the first radio signal RS1 can be a frequency modulation (FM) signal or a television signal.

In the step S153, the first radio signal RS1 is converted to be a second radio signal RS2 by the processing unit 230. For example, the second radio signal RS2 can be a Bluetooth signal or a wireless network signal.

In the step S154, the second radio signal RS2 is transmitted to the transceiver 110 of the host device 100 by the transceiver 210 of the peripheral device 200.

In the step S155, the second radio signal RS2 is received by the transceiver 110 of the host device 100 and converted to be the media signal MS by processing unit 130 of the host device 100.

In the step S156, the media signal MS converted from the second radio signal RS2 which is transmitted from the peripheral device 200 is played by the outputting unit 120 of the host device 100.

Please referring to FIG. 4B, if the operation mode is the dynamic mode, then the process proceeds to the step S160. In the step S160, the first receiving channel of the host device 100 is set.

In the step S161, the second receiving channel of the peripheral device 200 corresponding to the first receiving channel is set by the host device 100.

In the step S162, the third radio signal RS3 is received through the first receiving channel by the transceiver 110 of the host device 100.

In the step S163, the quality of the third radio signal RS3 which is received through the first receiving channel of the host device 100 is read. For example, the quality of the third radio signal RS3 can be determined via a received signal strength indication (RSSI) or a signal to noise ratio (SNR).

In the step S164, whether the quality of the third radio signal RS3 is lower than a predetermined level is determined by the processing unit 130. If the quality of the third radio signal RS3 is lower than the predetermined level, then the process proceeds to the step S170; if the quality of the third radio signal RS3 is not lower than the predetermined level, then the process proceeds to the step S180.

In the step S180, the third radio signal RS3 is converted to be the media signal MS by the processing unit 130 of the host device 100.

In the step S181, the media signal MS converted from the third radio signal RS3 is played by the outputting unit 120 of the host device 100.

In the step S170, the first radio signal RS1 is received through the second receiving channel by the transceiver 210 of the peripheral device 200.

In the step S171, the quality of the first radio signal RS1 received through the second receiving channel of the peripheral device 200 is read by the host device 100. In this step, the quality of the first radio signal RS1 can be transmitted from the peripheral device 200 to the host device 100 by the transceiver 210.

In the step S172, whether the quality of the third radio signal RS3 which is received through the first receiving channel is lower than that of the first radio signal RS1 which is received through the second receiving channel is determined by the processing unit 130. If the quality of the third radio signal RS3 is lower than that of the first radio signal RS1, then the process proceeds to the step S190; if the quality of the third radio signal RS3 is not lower than that of the first radio signal RS1, then the process proceeds to the step S180.

In the step S190, the first radio signal RS1 is converted to be the second radio signal RS2 by the processing unit 230 of the peripheral device 200.

In the step S191, the second radio signal RS2 is transmitted to the transceiver 110 of the host device 100 by the transceiver 210 of the peripheral device 200.

In the step S192, the second radio signal RS2 is received by the transceiver 110 of the host device 100 and converted to be the media signal MS by processing unit 130 of the host device 100.

In the step S193, the media signal MS converted from the second radio signal RS2 which is transmitted from the peripheral device 200 is played by the outputting unit 120 of the host device 100.

The media signal broadcasting method described above can receive a radio signal by the host device 100 or the peripheral device 200 selectively. In some case, the host device 100 cannot receive the radio signal very well due to the location. In that case, the peripheral device 200 can receive the radio signal and then transmits the content the radio signal to the host device 100. Therefore, the host device 100 can broadcast the radio signal very well, even if the location is not suitable for receiving the radio signal.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A media signal broadcasting method, comprising:

providing a host device and a peripheral device;

receiving a first radio signal by the peripheral device;

converting the first radio signal to be a second radio signal by the peripheral device;

transmitting the second radio signal to the host device by the peripheral device;

receiving the second radio signal and converting the second radio signal to be a media signal by the host device;

receiving a third radio signal and converting the third radio signal to be the media signal by the host device, wherein the second radio signal converted from the first radio signal and the third radio signal are directly received from two different transmitters;

reading a quality of the third radio signal received by the host device; and playing the media signal converted from the third radio signal or the second radio signal by the host device, including playing the media signal converted from the second radio signal, if the quality of the third radio signal is lower than a predetermined level, and playing the media signal converted from the third radio signal, if the quality of the third radio signal is not lower than the predetermined level.

2. The media signal broadcasting method according to claim 1, further comprising:

setting a first receiving channel of the host device for receiving the third radio signal; and setting a second receiving channel of the peripheral device for receiving the first radio signal.

3. The media signal broadcasting method according to claim 1, wherein the quality of the third radio signal is determined via a received signal strength indication (RSSI) or a signal to noise ratio (SNR).

4. The media signal broadcasting method according to claim 1, further comprising:

reading the quality of the first radio signal by the host device;

wherein in the step of playing the media signal, the media signal converted from the second radio signal is played, if the quality of the third radio signal is lower than that of the first radio signal;

in the step of playing the media signal, the media signal converted from the third radio signal is played, if the quality of the third radio signal is not lower than that of the first radio signal.

5. The media signal broadcasting method according to claim 4, wherein the quality of the third radio signal and the quality of the first radio signal are determined via a received signal strength indication (RSSI) or a signal to noise ratio (SNR).

6. The media signal broadcasting method according to claim 1, wherein each of the first radio signal and the third radio signal is a frequency modulation (FM) signal or a television signal, and the second radio signal is a Bluetooth signal or a wireless network signal.

7. A media signal broadcasting system, comprising:

a host device, including:

a first transceiver, used for receiving a third radio signal;

a first processing unit, used for converting the third radio signal to be a media signal; and an outputting unit; and a peripheral device, including:

a second transceiver, used for receiving a first radio signal; and a second processing unit, used for converting the first radio signal to be a second radio signal, wherein the first transceiver is used for receiving the second radio signal transmitted from the second transceiver, the first processing unit is further used for converting the second radio signal to be the media signal, and for reading a quality of the third radio signal, and the outputting unit is used for playing the media signal converted from the second radio signal, if the quality of the third radio signal is lower than a predetermined level, and the media signal converted from the third radio signal, if the quality of the third radio signal is not lower than the predetermined level, wherein the second radio signal converted from the first radio signal and the third radio signal are directly received from two different transmitters.

8. The media signal broadcasting system according to claim 7, wherein the first processing unit is further used for setting a first receiving channel of the host device for receiving the third radio signal, and the second processing unit is further used for setting a second receiving channel of the peripheral device for receiving the first radio signal.

9. The media signal broadcasting system according to claim 7, wherein the quality of the third radio signal is determined via a received signal strength indication (RSSI) or a signal to noise ratio (SNR).

10. The media signal broadcasting system according to claim 7, wherein the first processing unit is further used for reading the quality of the first radio signal;

the media signal converted from the second radio signal is played by the outputting unit, if the quality of the third radio signal is lower than that of the first radio signal;

the media signal converted from the third radio signal is played by the outputting unit, if the quality of the third radio signal is not lower than that of the first radio signal.

11. The media signal broadcasting system according to claim 10, wherein the quality of the third radio signal and the quality of the first radio signal are determined via a received signal strength indication (RSSI) or a signal to noise ratio (SNR).

12. The media signal broadcasting method according to claim 7, wherein each of the third radio signal and the first radio signal is a frequency modulation (FM) signal or a television signal, and the second radio signal is a Bluetooth signal or a wireless network signal.

13. A peripheral device, comprising:

a transceiver, used for receiving a first radio signal; and a processing unit, used for converting the first radio signal to be a second radio signal, wherein a host device is used for receiving the second radio signal and a third radio signal, and for reading a quality of the third radio signal, the second radio is transmitted from the transceiver of the peripheral device, and the host device is further used for playing a media signal converted from the second radio signal, if the quality of the third radio signal is lower than a predetermined level, and a media signal converted from the third radio signal, if the quality of the third radio signal is not lower than the predetermined level, wherein the second radio signal converted from the first radio signal and the third radio signal are directly received from two different transmitters.

14. The peripheral device according to claim 13, wherein the host device is further used for setting a first receiving channel for receiving the third radio signal, and the processing unit is further used for setting a second receiving channel for receiving the first radio signal.

15. The peripheral device according to claim 13, wherein the quality of the third radio signal is determined via a received signal strength indication (RSSI) or a signal to noise ratio (SNR).

16. The peripheral device according to claim 13, wherein the host device is further used for reading the quality of the first radio signal;

the media signal converted from the second radio signal is played by the host device, if the quality of the third radio signal is lower than that of the first radio signal;

the media signal converted from the third radio signal is played by the host device, if the quality of the third radio signal is not lower than that of the first radio signal.

17. The peripheral device according to claim 16, wherein the quality of the third radio signal and the quality of the first radio signal are determined via a received signal strength indication (RSSI) or a signal to noise ratio (SNR).

18. The peripheral device according to claim 13, wherein each of the third radio signal and the first radio signal is a frequency modulation (FM) signal or a television signal, and the second radio signal is a Bluetooth signal or a wireless network signal.

19. A host device, comprising:

a transceiver, used for receiving a third radio signal and a second radio signal, wherein the second radio signal is converted from a first radio signal received by a peripheral device;

a processing unit, used for converting the third radio signal or the second radio signal to be a media signal and for reading a quality of the third radio signal, wherein the second radio signal converted from the first radio signal and the third radio signal are directly received from two different transmitters; and an outputting unit, for playing the media signal converted from the second radio signal, if the quality of the third radio signal is lower than a predetermined level, and the media signal converted from the third radio signal, if the quality of the third radio signal is not lower than the predetermined level.

20. The host device according to claim 19, wherein the processing unit is further used for setting a first receiving channel for receiving the third radio signal, and the peripheral device is further used for setting a second receiving channel for receiving the first radio signal.

21. The host device according to claim 19, wherein the quality of the third radio signal is determined via a received signal strength indication (RSSI) or a signal to noise ratio (SNR).

22. The host device according to claim 19, wherein the processing unit is further used for reading the quality of the first radio signal;

the media signal converted from the second radio signal is played by the outputting unit, if the quality of the third radio signal is lower than that of the first radio signal;

the media signal converted from the third radio signal is played by the outputting unit, if the quality of the third radio signal is not lower than that of the first radio signal.

23. The host device according to claim 22, wherein the quality of the third radio signal and the quality of the first radio signal are determined via a received signal strength indication (RSSI) or a signal to noise ratio (SNR).

24. The host device according to claim 19, wherein each of the third radio signal and the first radio signal is a frequency modulation (FM) signal or a television signal, and the second radio signal is a Bluetooth signal or a wireless network signal.

* * * * *